US008907876B2

(12) United States Patent
Hasumi et al.

(10) Patent No.: US 8,907,876 B2
(45) Date of Patent: Dec. 9, 2014

(54) PIXEL CIRCUIT, IMAGE DISPLAY APPARATUS, DRIVING METHOD THEREFOR AND DRIVING METHOD OF ELECTRONIC DEVICE

(75) Inventors: Taro Hasumi, Yamato (JP); Yoshinao Kobayashi, Yamato (JP); Keigo Kanoh, Yamato (JP)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 13/616,513

(22) Filed: Sep. 14, 2012

(65) Prior Publication Data

US 2013/0002637 A1 Jan. 3, 2013

Related U.S. Application Data

(63) Continuation of application No. 11/768,673, filed on Jun. 26, 2007, now Pat. No. 8,289,244, which is a continuation of application No. PCT/JP2005/023967, filed on Dec. 27, 2005.

(30) Foreign Application Priority Data

Dec. 27, 2004 (JP) ..... 2004-377347
Nov. 30, 2005 (JP) ..... 2005-344987

(51) Int. Cl.
*G09G 3/30* (2006.01)
*G09G 5/00* (2006.01)
*G09G 3/32* (2006.01)

(52) U.S. Cl.
CPC ..... *G09G 3/3233* (2013.01); *G09G 2310/0254* (2013.01); *G09G 2320/043* (2013.01); *G09G 2300/0842* (2013.01)
USPC ..... 345/78; 345/79; 345/211

(58) Field of Classification Search
USPC ..... 345/76–84, 204–205, 209, 211–215; 315/169.3
See application file for complete search history.

(56) References Cited

U.S. PATENT DOCUMENTS

| | | | | |
|---|---|---|---|---|
| 5,748,160 | A | 5/1998 | Shieh et al. | |
| 6,429,837 | B1 | 8/2002 | Ishizuka et al. | |
| 6,724,376 | B2 * | 4/2004 | Sakura et al. | 345/204 |
| 6,750,833 | B2 | 6/2004 | Kasai | |
| 6,870,192 | B2 | 3/2005 | Yamazaki et al. | |
| 7,239,296 | B2 | 7/2007 | Cheng et al. | |
| 2002/0047839 | A1 | 4/2002 | Kasai | |
| 2003/0062545 | A1 | 4/2003 | Yamazaki et al. | |

(Continued)

FOREIGN PATENT DOCUMENTS

| | | | |
|---|---|---|---|
| JP | 4-328791 | A | 11/1992 |
| JP | 9-138659 | A | 5/1997 |

(Continued)

OTHER PUBLICATIONS

S. Ono et al., Pixel Circuit for a-Si AM-OLED, International Display Technology, 2003, Japan.

*Primary Examiner* — Joe H Cheng
*Assistant Examiner* — Keith Crawley
(74) *Attorney, Agent, or Firm* — Birch, Stewart, Kolasch & Birch, LLP

(57) ABSTRACT

A pixel circuit has a light emitting element and a driver electrically connected to the light emitting element. A reverse bias voltage is applied to the driver to reduce a shift amount of a threshold voltage of the driver.

17 Claims, 11 Drawing Sheets

(56) References Cited

U.S. PATENT DOCUMENTS

| | | | | |
|---|---|---|---|---|
| 2003/0107565 | A1 | 6/2003 | Libsch et al. | |
| 2003/0160745 | A1* | 8/2003 | Osame et al. | 345/82 |
| 2004/0061671 | A1 | 4/2004 | Kawasaki et al. | |
| 2004/0113873 | A1 | 6/2004 | Shirasaki et al. | |
| 2004/0147127 | A1* | 7/2004 | Noguchi et al. | 438/690 |
| 2005/0030264 | A1* | 2/2005 | Tsuge et al. | 345/76 |
| 2005/0030265 | A1* | 2/2005 | Miyagawa | 345/76 |
| 2005/0057455 | A1 | 3/2005 | Peng | |
| 2005/0057459 | A1 | 3/2005 | Miyazawa | |
| 2005/0057581 | A1 | 3/2005 | Horiuchi et al. | |
| 2006/0007072 | A1 | 1/2006 | Choi et al. | |
| 2006/0012587 | A1 | 1/2006 | Stevenson et al. | |
| 2006/0138600 | A1 | 6/2006 | Miyazawa | |

FOREIGN PATENT DOCUMENTS

| | | | | | |
|---|---|---|---|---|---|
| JP | 11-305727 | A | | 11/1999 | |
| JP | 2002-091376 | A | | 3/2002 | |
| JP | 2002-169510 | A | | 6/2002 | |
| JP | 2003-195810 | A | | 7/2003 | |
| JP | 2003-216100 | A | | 7/2003 | |
| JP | 2003-216104 | A | | 7/2003 | |
| JP | 2004-118132 | A | | 4/2004 | |
| WO | WO 03023752 | | * | 3/2003 | G09G 3/32 |

* cited by examiner

PIXEL CIRCUIT, IMAGE DISPLAY APPARATUS, DRIVING METHOD THEREFOR AND DRIVING METHOD OF ELECTRONIC DEVICE

CROSS-REFERENCE TO RELATED APPLICATIONS

This application is a Continuation of application Ser. No. 11/768,673 filed on Jun. 26, 2007 now U.S. Pat. No. 8,289,244, which is the Continuation of PCT International Application No. PCT/JP2005/023967 filed on Dec. 27, 2005, which claims priority to Application No. 2004-377347 filed in Japan on Dec. 27, 2004, and Application No. 2005-344987 filed in Japan on Nov. 30, 2005. The entire contents of all of the above applications are hereby incorporated by reference.

BACKGROUND OF THE INVENTION

1. Field of the Invention

The present invention relates to a pixel circuit having a light emitting element, an image display apparatus and a driving method thereof. The present invention also relates to a driving method of an electronic device.

2. Description of the Related Art

Recently, many researchers have focused attention on electroluminescent elements (hereinafter also referred to as "light emitting elements"). In particular, studies on the application of the light emitting elements to image display apparatuses or lighting apparatuses have been actively carried out.

The above-described image display apparatuses include pixels at least including the light emitting elements and thin film transistors (hereinafter abbreviated as "TFTs") made of amorphous silicon, polycrystalline silicon, or the like. Control of the TFTs allows a desired current to flow through the light emitting elements, and the brightness, hue, saturation, or the like of the pixels are appropriately controlled.

It is known that a threshold voltage (hereinafter also referred to as a "Vth") of a TFT made of amorphous silicon (hereinafter also referred to as an "aSi-TFT") increases with time of using the TFT to cause a change in operating conditions. This phenomenon is called "Vth shift" or "deterioration" of the aSi-TFT. It is also known that the aSi-TFT provides a large change in the rate of deterioration depending on the use thereof, operating conditions, etc.

For example, in applications for which an aSi-TFT is used as a switch and a pulsed current flows through the aSi-TFT for a very short time, such as liquid crystal displays, the rate of deterioration of the aSi-TFT is low. On the other hand, in applications for which a large current flows through the aSi-TFT, such as organic light emitting elements, the rate of deterioration of the aSi-TFT is high.

Deterioration of aSi-TFTs affects the uniformity of an image and the response of pixels.

There is a circuit technique called Vth correction. This is a technique in which a Vth of an aSi-TFT is detected and a video signal is superimposed on the Vth to provide a uniform image regardless of the deterioration of the Vth of the aSi-TFT.

A Vth correction technique of the related art is described in, for example, S. Ono et al., Proceedings of IDW '03, 255 (2003). This document discloses a Vth correction technique performed by an image display apparatus using four TFTs and four control lines. The contents of this publication are incorporated herein by reference in their entirety.

SUMMARY OF THE INVENTION

According to an aspect of the invention, a pixel circuit includes a light emitting element and a driver electrically connected to the light emitting element. A reverse bias voltage is applied to the driver to reduce a shift amount of a threshold voltage of the driver.

According to another aspect of the invention, an image display apparatus includes a light emitting element, a driver electrically connected to the light emitting element, and a controller electrically connected to the driver. The controller is configured to apply a reverse bias voltage to the driver to reduce a shift amount of a threshold voltage of the driver.

According to another aspect of the invention, a driving method of a pixel circuit includes providing a pixel circuit which has a light emitting element and a driver electrically connected to the light emitting element. The driving method further includes a step of applying a voltage to the driver such that the light emitting element emits light. The driving method further includes a step of applying a reverse voltage to the driver to reduce a shift amount of a threshold voltage of the driver.

According to another aspect of the invention, a driving method of an electronic device includes a step of providing an electronic device includes an image display apparatus having a plurality of light emitting elements and a plurality of drivers electrically connected to the light emitting elements. The driving method further includes a step of setting the image display apparatus to a first state and a step of applying reverse bias voltages to the drivers in the first state. The driving method further includes a step of setting the image display apparatus to a second state after applying reverse bias voltages to the drivers.

DETAILED DESCRIPTION OF THE PREFERRED EMBODIMENTS

The present inventors have completed the present invention by analyzing in detail the operation of a light emitting element and a driver in an image display apparatus.

Figure 13:
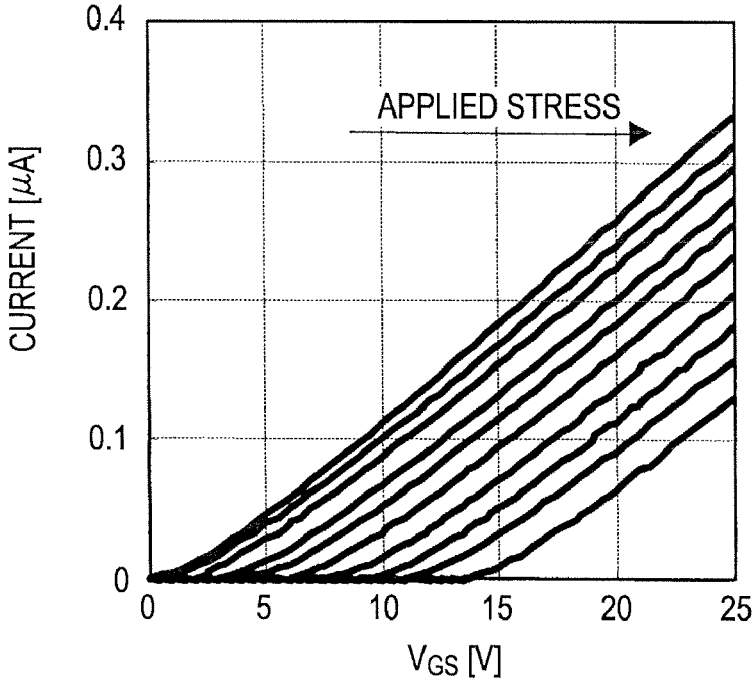
FIG. 13 is a diagram illustrating an example in which current characteristics with respect to a gate-source voltage of an aSi-TFT change in accordance with a stress.

FIG. 13 is a diagram illustrating an example in which current characteristics with respect to a gate-source voltage of an aSi-TFT change in accordance with a stress. In FIG. 13, points at which curves intersect the horizontal axis represent threshold voltages (Vth) of the aSi-TFT. As shown in FIG. 13, a positive bias voltage serving as an applied stress (a bias voltage for turning on the aSi-TFT) is continuously applied to a gate of the aSi-TFT, and thereby a current characteristic of the aSi-TFT is shifted from the leftmost curve (initial characteristic) to the right.

In FIG. 13, for example, the Vth of the second curve from the rightmost is about 10 V. The Vth of the rightmost curve is about 15 V. That is, the difference between the threshold voltages Vth of both curves is about 5 V. As can be seen from this result, the shift of the Vth of the aSi-TFT rapidly grows. If such an aSi-TFT is used in a driver, it is difficult to perform Vth correction of the driver in the region where the Vth shift of the driver rapidly grows.

Even before the above-described region where the shift of the threshold voltage of the driver rapidly grows, if the Vth shift of the driver varies pixel by pixel, it is very difficult to perform appropriate Vth correction for each pixel.

According to the embodiments of the present invention, the shift amount of a Vth of a driver can be reduced.

A plurality of embodiments and examples according to the present invention will be described in detail with reference to the drawings. The present invention is not limited by the following embodiments and examples.

First Embodiment

An image display apparatus in this embodiment includes a plurality of pixels arranged in a matrix. Each of the pixels has a light emitting element and a driver.

Figure 1:
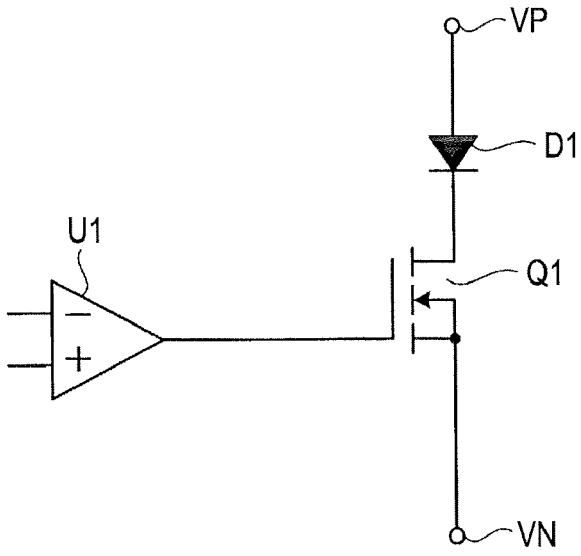
FIG. 1 is a diagram illustrating an example structure of a pixel circuit corresponding to one pixel of an image display apparatus according to a first embodiment of the present invention.

FIG. 1 is a diagram illustrating an example structure of a pixel circuit corresponding to one pixel of an image display apparatus according to the present embodiment. The pixel circuit shown in FIG. 1 is illustrated in a simple manner.

The pixel circuit shown in FIG. 1 includes a light emitting element D1, a driver Q1 connected in series to the light emitting element D1, and a controller U1 controlling the driver Q1. The light emitting element D1 is, for example, an organic light emitting element. The light emitting element D1 has an anode connected to a terminal on the high voltage side (hereinafter referred to as a "VP terminal"), and a cathode connected to a drain terminal of the driver Q1 formed of, for example, an aSi-TFT. A source terminal of the driver Q1 is connected to a terminal on the low applied voltage side (hereinafter referred to as a "VN terminal"), and a gate terminal of the driver Q1 is connected to an output terminal of the controller U1. The controller U1 controls a gate voltage of the driver Q1, and has a function to apply a reverse bias voltage to the driver Q1. The controller U1 includes, for example, one or a plurality of TFTs, a capacitive element such as a capacitor, a control line for supplying a voltage controlling the TFT, and so on. The connection structure shown in FIG. 1 is particularly called "gate control/drain drive".

Next, the operation of the pixel circuit shown in FIG. 1 will be described. The pixel circuit operates over four periods: a preparation period, a threshold voltage detection period, a write period, and a light emitting period.

First, in the preparation period, a predetermined amount of electric charge is accumulated in the light emitting element D1 (more specifically, a parasitic capacitance of the light emitting element D1). The reason why electric charge is accumulated in the light emitting element D1 during the preparation period is to supply a current between the drain and source of the driver Q1 when a threshold voltage of the driver Q1 is detected.

Next, in the threshold voltage detection period, the VP terminal and the VN terminal are set to substantially the same potential. At this time, the gate-source voltage of the driver Q1 becomes substantially equal to a Vth, and a voltage corresponding to the Vth is held in a capacitive element (not shown). The operation of holding the Vth in the capacitive element is performed using the electric charge accumulated in the light emitting element D1 during the preparation period.

Further, in the write period, a predetermined voltage in which a data signal is superimposed on the Vth of the driver Q1 detected during the threshold voltage detection period is held in the capacitive element (not shown) or the like.

Finally, in the light emitting period, the predetermined voltage held in the capacitive element during the write period is applied to the driver Q1, and the light emitting element D1 is controlled to emit light.

The controller U1 controls the current flowing through the light emitting element D1 according to the above-described series of operations. By controlling the current, the brightness (gradation), hue, saturation, etc., of each pixel are set to appropriate values.

Next, the control operation of the controller U1 according to the present embodiment will be described. First, the controller U1 controls so as to apply a reverse bias voltage to the driver Q1 when the light emitting element D1 does not emit light. This control may be performed every frame period. The reverse bias voltage may be applied when the image display apparatus is not used.

The term "frame period" as used herein is defined as a period for which an image displayed on a display of the image display apparatus is refreshed. For example, when the display is driven at 60 Hz, one frame period is 16.67 ms. In general, during one frame period of 16.67 ms, the operation in which a light emitting element emits light on the basis of a driving voltage determined according to a gradation level is repeated.

Figure 2:
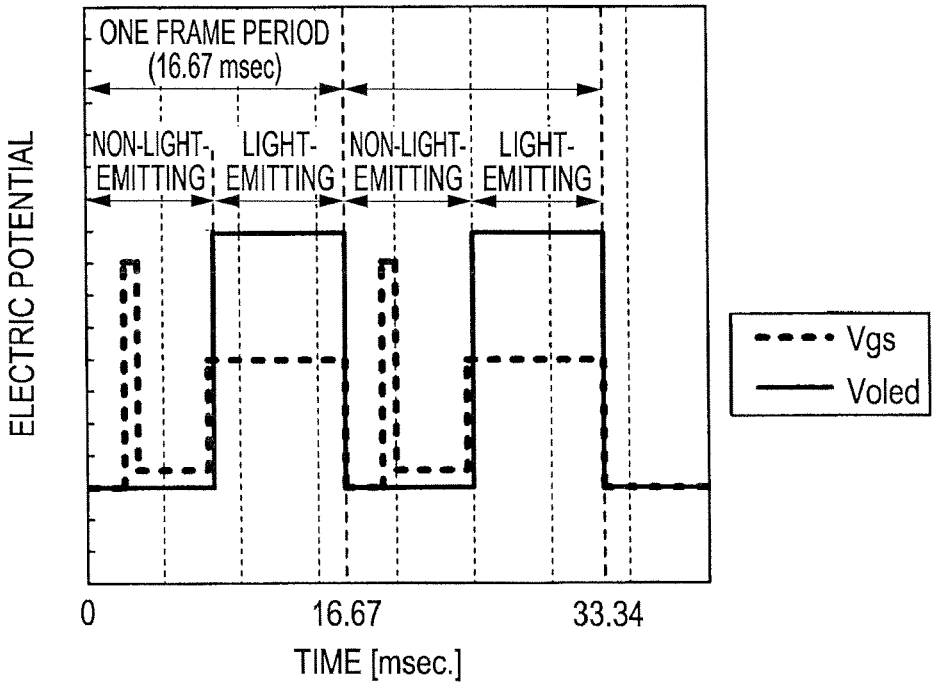
FIG. 2 is a diagram illustrating an example of the drive waveform for an organic light emitting element that is controlled to emit or not to emit light.

FIG. 2 is a diagram illustrating, an example of the drive waveform for an organic light emitting element that is controlled to emit or not to emit light. In FIG. 2, Vgs denotes the potential difference between a gate and source (gate-source voltage) of a driving transistor, and Voled denotes the potential difference between an anode and cathode of the organic light emitting element. As shown in FIG. 2, the organic light emitting element is driven at intervals of 16.67 ms (60 Hz), and the non-light emitting and light emitting operations are repeatedly performed at the intervals described above.

The term "when the image display apparatus is not used" means the state where no image data is supplied to each pixel circuit and all light emitting elements are not energized.

The term "reverse bias voltage" means that when the driver Q1 is an n-type transistor, the gate-source voltage Vgs (Vgs=Vg (gate potential)−Vs (source potential)) of the transistor is generally lower than a threshold voltage Vth of the transistor.

The term "reverse bias voltage" also means that when the driver Q1 is a p-type transistor, the gate-source voltage Vgs (whose definition is the same as that of an n-type transistor) of the transistor is generally higher than a threshold voltage Vth of the transistor.

For example, in the case of an n-type transistor, if the threshold voltage Vth is 2 V, the gate potential Vg is −3 V, the drain potential Vd is 10 V, and the source potential Vs is 0 V, Vgs=Vg−Vs=−3 V is obtained. Since Vgs<Vth, the gate-source voltage Vgs is a reverse bias voltage. A reverse bias voltage value itself is represented by the value of the voltage Vgs.

According to the definition of the reverse bias voltage described above, whether or not a voltage applied to the driver Q1 is a reverse bias voltage depends on the value of the threshold voltage Vth. A method for determining a threshold voltage Vth of the driver Q1 formed of a TFT will now be described in the context of an n-type transistor.

As noted above, a gate-source voltage of the TFT is represented by Vgs, a drain-source voltage is represented by Vds (Vds=Vd (drain potential)−Vs (source potential)), and a threshold voltage is represented by Vth. A drain-source current flowing through the TFT is represented by Ids. The Ids is approximated using the equation below for each of a saturation region and a linear region:

(a) In the case of Vgs−Vth<Vds (saturation region):

$$Ids=\beta\times[(Vgs-Vth)^2] \quad (1)$$

(b) In the case of Vgs−Vth≥Vds (linear region):

$$Ids=2\times\beta\times[(Vgs-Vth)\times Vds-(\tfrac{1}{2}\times Vds^2)] \quad (2)$$

where β in equations (1) and (2) is a characteristic factor for the TFT, and is given by the equation below where the channel width of the TFT is referred to as "W" (unit: cm), the channel length is referred to as L (unit: cm), the capacitance per unit area of an insulation film is referred to as "Cox" (unit: F/cm$^2$), and the mobility is referred to as "μ" (unit: cm$^2$/Vs):

$$\beta=\tfrac{1}{2}\times W\times\mu/(L\times Cox) \quad (3)$$

Here, the case of the saturation region is considered. When the square root of Ids in equation (1) is taken, the following equation is obtained:

$$(Ids)^{1/2}=(\beta)^{1/2}\times(Vgs-Vth) \quad (4)$$

As shown in equation (4), $(Ids)^{1/2}$ is proportional to (Vgs−Vth). This means that the square root of the drain current Ids of the TFT is linear to the gate voltage (Vgs). Further, as is apparent from equation (4), in the case of $(Ids)^{1/2}=0$, Vgs is equal to Vth. Defining the Vth of the TFT using this relationship is a commonly used method. Also in the present embodiment, this method can be used to determine a Vth of the TFT.

Figure 3:
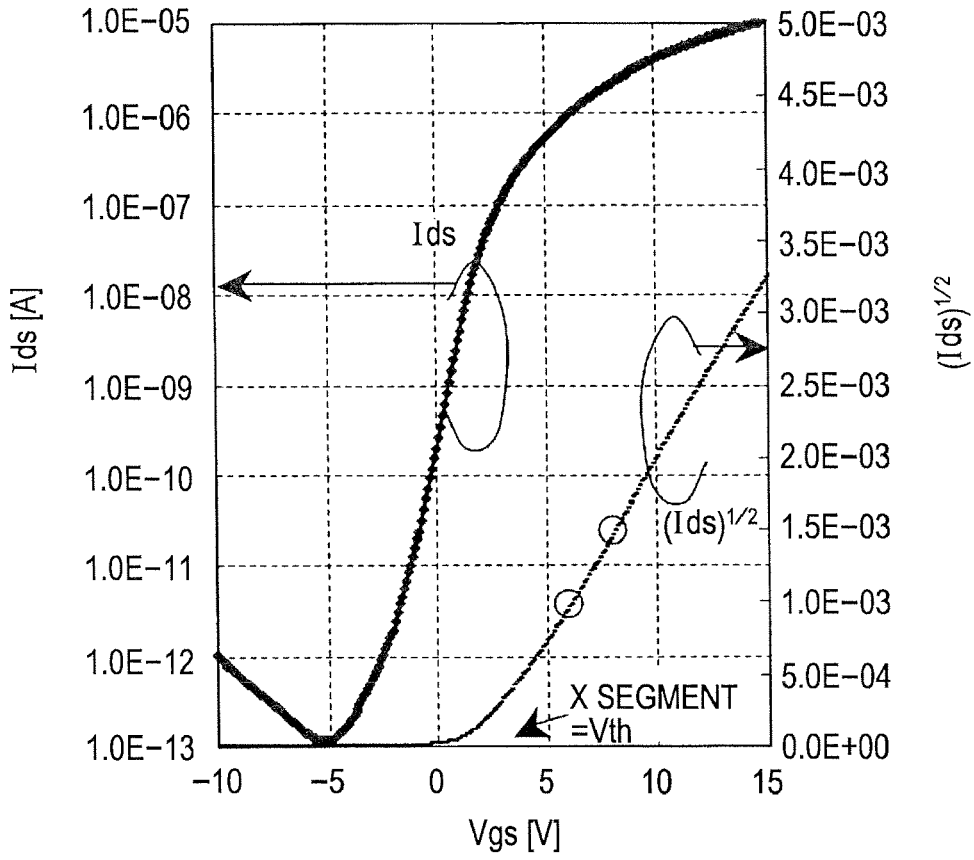
FIG. 3 is a graph illustrating the characteristics of Ids and $(Ids)^{1/2}$ with respect to a change in Vgs of a TFT.

FIG. 3 is a graph showing the characteristics of Ids and $(Ids)^{1/2}$ with respect to a change in Vgs of a TFT. The graph shown in FIG. 3 is an example of a plot of the currents Ids and $(Ids)^{1/2}$ when in the TFT, Vds is fixed to 10 V and Vgs is varied from −10 V to 15 V. The drain current Ids is logarithmically plotted on the left vertical axis, and the square root $(Ids)^{1/2}$ of the drain current is linearly plotted on the right vertical axis. As shown in FIG. 3, the linearity of $(Ids)^{1/2}$ is maintained in a range of Vgs=3 to 10 V within the saturation region where the TFT is turned on.

In a typical amorphous silicon n-type TFT, the Vth is not more than 5 V. When the Vth of the TFT is determined with reference to FIG. 3, the following method can be used. Two points indicated by the sign '○' on the $(Ids)^{1/2}$ characteristic curve shown in FIG. 3 represent Vgs=6 V and 8V. An X segment of the straight line that passes through the two points is the value of Vgs obtained in the case of $(Ids)^{1/2}=0$ in equation (4), that is, (Vgs−Vth)=0. The X segment is therefore a threshold voltage Vth of the TFT. When read from the graph shown in FIG. 3, Vth=2.13 V is obtained.

Next, a period in which the reverse bias voltage is applied to the driver Q1 will be described. More specifically, the period in which the reverse bias voltage is applied to the driver Q1 within a frame period is preferably not less than 5% of the frame period. More preferably, the period in which the reverse bias voltage is applied to the driver Q1 is not less than 10% of the frame period.

For example, as described above, the image display apparatus is generally scanned at 60 Hz for one frame period, and one frame period is 1/60 second=16.67 ms. The average time for which the light emitting element emits light during the light emitting period described above (an average light-emitting period within a frame period) is about 5 ms, which is substantially 30% of a frame period. It is sufficiently effective to set the period in which the reverse bias voltage is applied to not less than substantially 1/10 of the light emitting period (that is, the period in which a positive bias voltage is applied to the driver) to suppress deterioration of the driver. That is, a deterioration suppression effect can be achieved even if the reverse bias voltage is applied for 5% of a frame period. The closer to the light emitting period the period in which the reverse bias voltage is applied is, the more effectively deterioration is reduced. Therefore, more preferably, the period in which the reverse bias voltage is applied is not less than 10% of a frame period. It is effective that the period in which the reverse bias voltage is applied is not less than 0.1 ms even if it is not more than 1 ms.

By applying a reverse bias voltage within a frame period, the advantage of recovering the Vth shift of the driver at an early stage is also achieved. For example, the current characteristics shown in FIG. 13 with respect to the gate-source voltage of the aSi-TFT exhibit a phenomenon that the Vth shift rapidly increases due to the accumulation of applied stresses. That is, correction of the Vth shift at an early stage has the effect of reducing the accumulation of applied stresses. Therefore, even with a period that is not more than about 10% of a frame period (the average light-emitting period within a frame period), which corresponds to the period in which the light emitting element emits light, the effect of correcting the Vth shift can be achieved. In order to expect such an effect, the period in which the reverse bias voltage is applied may be set to, for example, about 5% of a frame period (about 50% of the average light-emitting period within a frame period).

Differently from the method described above, for example, when all light emitting elements are in a non-light emitting state (for example, when the image display apparatus is not used), a reverse bias voltage may be applied to a driver. This method is advantageous in that a period in which the reverse bias voltage is applied can be intensively secured. For example, when a reverse bias voltage is applied for a predetermined time within a frame period, it is necessary to secure an available time in which the reverse bias voltage can be applied. As the complexity of the structure of the pixel circuit increases, it becomes difficult to secure the available time.

On the other hand, in the case where a reverse bias voltage is applied when the image display apparatus is not used, it is possible to secure a longer period in which the reverse bias voltage is applied and to enhance the Vth shift correction effect. For example, the reverse bias voltage can be applied to the driver for a period not less than a frame period. Preferably, the period in which the reverse bias voltage is applied to the driver is not less than at least a frame period.

In the case where a reverse bias voltage is applied to a driver when all light emitting elements are in a non-light emitting state (for example, when the image display apparatus is not used), however, in view of power consumption, it is not advisable that the period in which the reverse bias voltage is applied be significantly long. Specifically, preferably, the period in which the reverse bias voltage is applied is not more than 20% of the total time in which the apparatus is used. It is sufficiently effective if the period in which the reverse bias voltage is applied is about 30 to 60 seconds.

Reverse bias voltages applied to drivers for a plurality of pixels are set to be substantially equal between the pixels, thereby providing simple control of the operation of applying the reverse bias voltages to the drivers. Further, the amount of shift of threshold voltages of the drivers can become substantially uniform across the pixels, and uniform image quality can be achieved. The range of variations in the reverse bias voltages applied to the drivers across the pixels is preferably within ±0.5 V, more preferably within ±0.3 V, further preferably within ±0.1 V.

The following examples 1 to 3 will be described with respect to the case in which a driver is an n-type transistor.

Example 1

Figure 7:
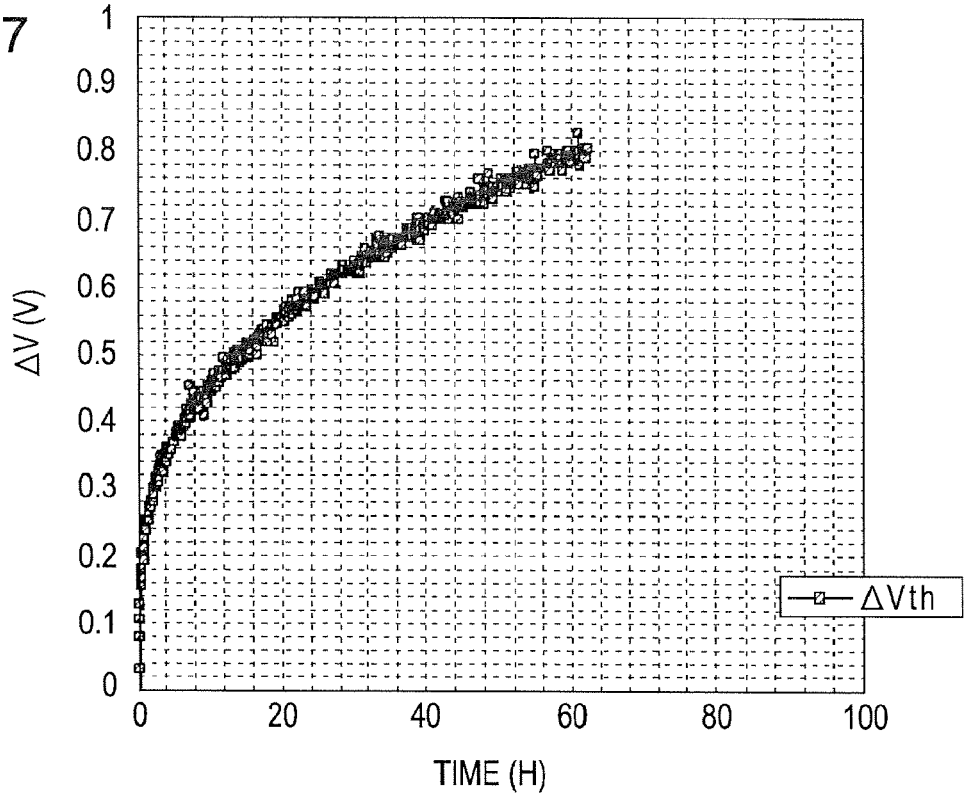
FIG. 7 is a diagram illustrating the relationship between a lighting time of a driver Q1 in the pixel circuit illustrated in FIG. 1 and a threshold voltage shift when no reverse bias voltage is applied to the driver Q1.
Figure 8:
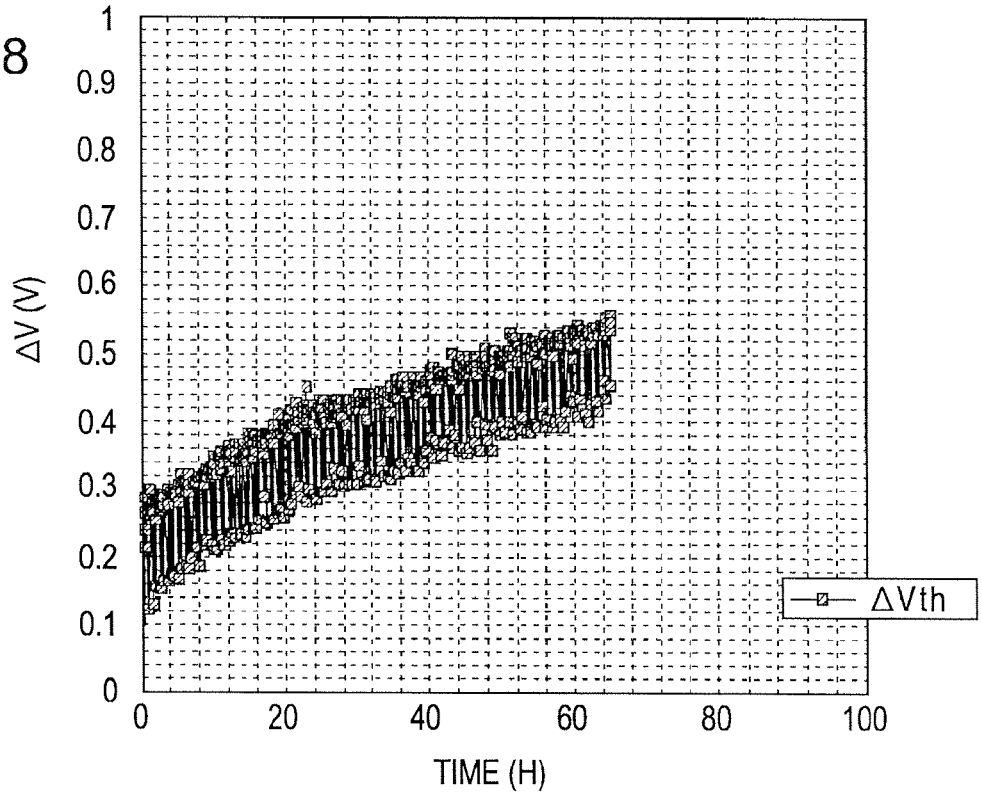
FIG. 8 is a diagram illustrating the relationship between a lighting time of the driver Q1 in the pixel circuit illustrated in FIG. 1 and a threshold voltage shift.
Figure 9:
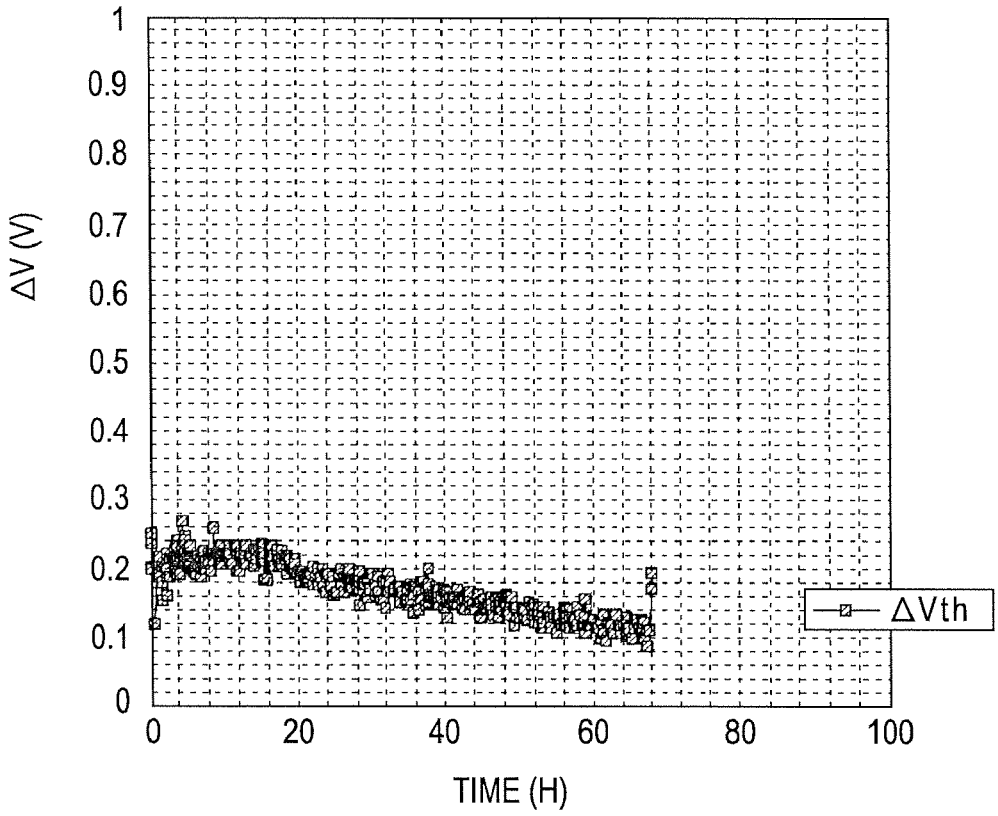
FIG. 9 is a diagram illustrating the relationship between a lighting time of the driver Q1 in the pixel circuit illustrated in FIG. 1 and a threshold voltage shift.

FIG. 7 is a diagram illustrating the relationship between a lighting time of the driver Q1 in the pixel circuit shown in FIG. 1 and the Vth shift ΔV when no reverse bias voltage was applied to the driver Q1, and FIGS. 8 and 9 are diagrams illustrating the relationship between a lighting time of the driver Q1 in the pixel circuit shown in FIG. 1 and the Vth shift when a reverse bias voltage was applied to the driver Q1. The lighting time means the time during which the driver Q1 is driven so as to have the light emitting element emit light. FIGS. 8 and 9 show the operation with repetitions of a lighting time of 10 minutes and a non-lighting time of 20 minutes. In particular, FIG. 8 shows the case where the reverse bias voltage was "−1 V", and FIG. 9 shows the case where the reverse bias voltage was "−5 V".

As shown in FIG. 7, in the case where no reverse bias voltage was applied, a Vth shift of about 0.8 V was observed under continuous operation for about 60 hours. As shown in FIG. 8, in the case where a reverse bias voltage of −1 V was applied, the Vth shift was reduced to about 0.45 V, and the effect of applying the reverse bias voltage was found, whereas, it is found that variations in Vth shift became slightly larger and small variations in Vth shift tended to be generated near the zero bias voltage. However, the maximum value of the Vth shift was about 0.54 V, and it is apparent that the effect of reducing the Vth shift exists even with a reverse bias voltage as low as about −1 V.

As shown in FIG. 9, in the case where a reverse bias voltage of −5 V was applied, variations in Vth shift were small, and the magnitude of Vth slowly decreased. From this fact, it is presumed that the effect of suppressing the deterioration of the driver as well as the effect of recovering the deterioration of the driver can be achieved depending on the magnitude of the applied reverse bias voltage. As is apparent from the comparison with the results of Example 2 described below, the shorter the period in which a reverse bias voltage is applied, the higher the effect of recovering from the deterioration of the driver.

As causes of the Vth shift being suppressed by the application of a reverse bias voltage, the following two are conceivable in the case of an aSi-TFT:

1. Although the channel layer made of a-Si:H is prone to be thermally unstable, the unstable channel layer is stabilized by applying a reverse bias voltage.

2. The electric charge stored in a gate insulation film made of SiN or the like is removed by applying a reverse bias voltage.

With regard to item 1 above, a phenomenon that the Vth shift was suppressed by annealing at 230° C. was observed. This phenomenon is considered to indicate that the Vth shift was suppressed as a result of stabilizing the thermally unstable state of the channel layer.

Example 2

Figure 10:
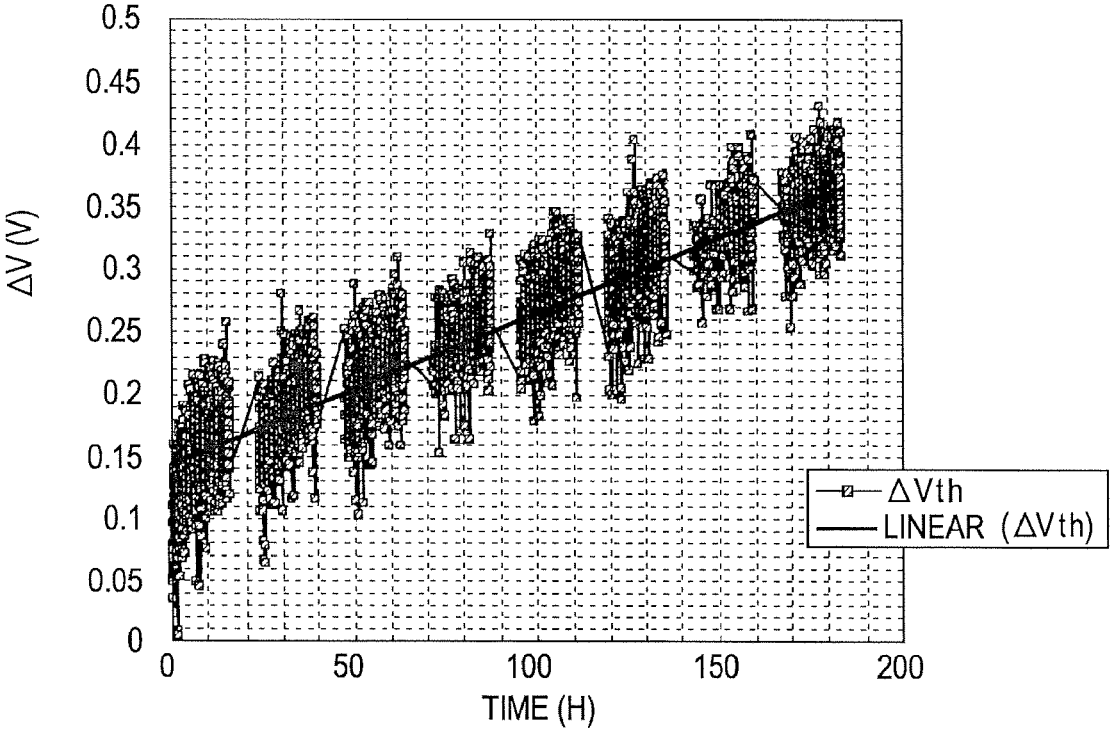
FIG. 10 is a diagram illustrating the relationship between a lighting time of the driver Q1 in the pixel circuit illustrated in FIG. 1 and a threshold voltage shift.
Figure 11:
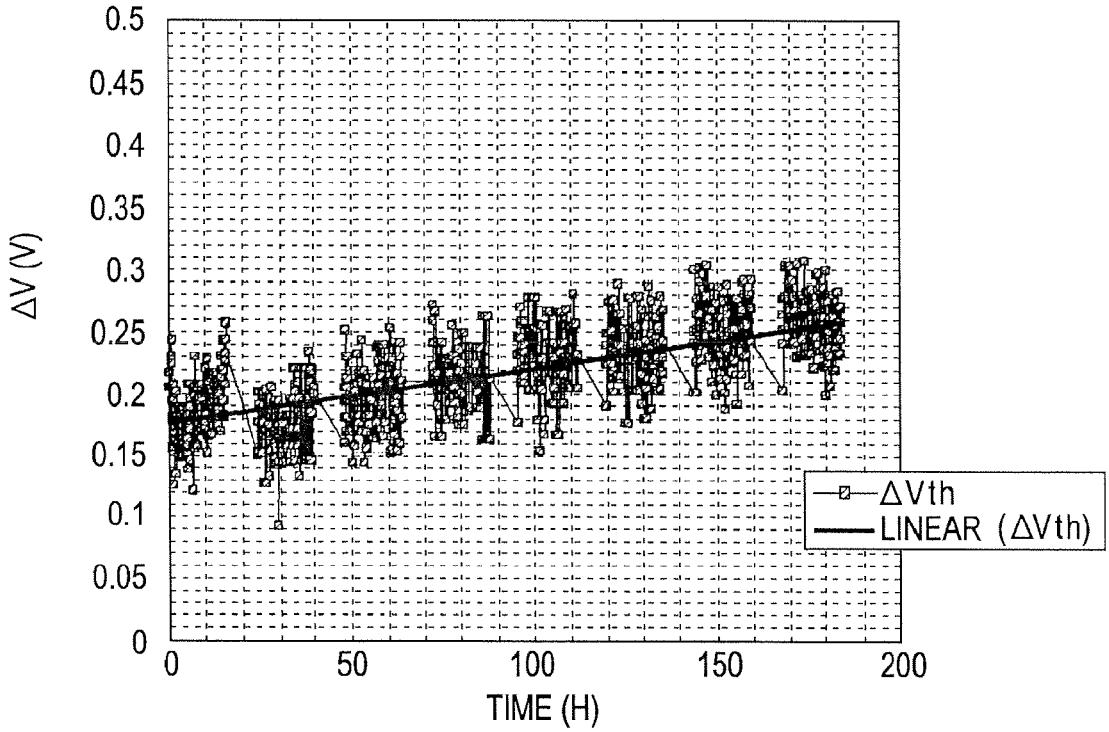
FIG. 11 is a diagram illustrating the relationship between a lighting time of the driver Q1 in the pixel circuit illustrated in FIG. 1 and a threshold voltage shift.

FIGS. 10 and 11 are diagrams illustrating characteristics under similar conditions to those shown in FIGS. 7 and 9, respectively. FIG. 10 shows the case where a driver was continuously used for 16 hours during daytime with repetitions of a lighting time of 3 minutes and a non-lighting time of 17 minutes and was in a non-lighting state for 8 hours during nighttime. FIG. 10 shows the case where the gate, source, and drain voltages of the driver were simply released for the non-lighting time during nighttime. On the other hand, FIG. 11 shows the case where the driver was continuously used for 16 hours during daytime with repetitions of a lighting time of 3 minutes and a non-lighting time of 17 minutes and was in a non-lighting state for 8 hours during nighttime. FIG. 11 shows the case where the drain-source voltage was maintained at the same potential for the non-lighting time during nighttime and a reverse bias voltage of −5 V was applied to the gate-source voltage for the initial 1 hour within the non-lighting time while 0 V was maintained in the other hours.

As shown in FIG. 10, in the case where the gate, source, and drain voltages of the driver were simply released for the non-lighting time during nighttime, the Vth shift linearly increased, and deterioration of the driver was observed. In comparison with the case of continuous lighting shown in FIG. 7, considerably large variations in Vth shift were found. From this, it is presumed that variations in Vth shift are large in practical situations in which lighting and non-lighting are repeated.

On the other hand, as shown in FIG. 11, in the case where a reverse bias voltage of −5 V was applied to the gate-source voltage for the initial 1 hour within the non-lighting time during nighttime, the rate of increase of Vth shift decreased and variations in Vth shift were also small. It is found that even with a comparatively long time use, deterioration of the driver can be reduced by applying a predetermined reverse bias voltage for a non-operating time after operation. In such a case, it is also found that even though the period in which the reverse bias voltage is applied is significantly shorter than the operating time, a predetermined improvement effect can be obtained.

Example 3

Figure 12:
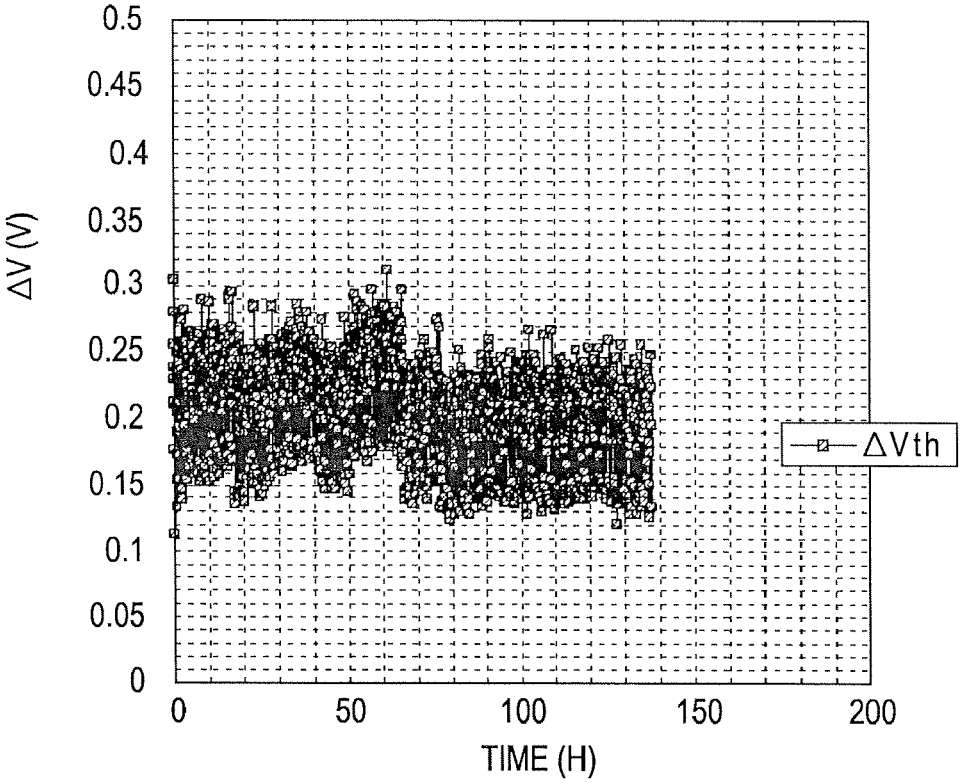
FIG. 12 is a diagram illustrating the relationship between a lighting time of the driver Q1 in the pixel circuit illustrated in FIG. 1 and a threshold voltage shift.

FIG. 12 is a diagram illustrating the characteristics obtained in the case where a driver was operated with repetitions of a lighting time of 3 minutes and a non-lighting time of 17 minutes and a reverse bias voltage of −5 V was applied between a gate and source of the driver for the initial 5 minutes within the non-lighting time. As shown in FIG. 12, it is found that temporal deterioration of the driver can be reduced even by applying the reverse bias voltage for the initial 5 minutes within the non-lighting time of 17 minutes.

In comparison between the characteristics shown in FIG. 12 and the characteristics shown in FIG. 9, even in the case where the same reverse bias voltage of −5 V was applied to the driver, the variations in Vth shift shown in FIG. 9 in which the reverse bias voltage was applied for a longer period (FIG. 9: 20 minutes, FIG. 12: 5 minutes) were smaller. In comparison between the characteristics shown in FIG. 11 and the characteristics shown in FIG. 9, the variations in Vth shift shown in FIG. 9 in which the reverse bias voltage was continuously applied for a shorter period (FIG. 9: continuously for 20 minutes, FIG. 11: continuously for 1 hour) were smaller. Consequently, in order to effectively reduce the variations in Vth shift, power consumption is also taken into account, and the waveform of the reverse bias voltage applied to the driver can also be intermittently changed.

For example, the waveform of the reverse bias voltage applied to the driver can be an attenuating sine wave centered at a predetermined voltage serving as a reverse bias voltage. In this case, the amplitude of the reverse bias voltage applied to the driver can be gradually mitigated, and deterioration of the driver and variations in the deterioration of the driver can be effectively reduced with a reduction in power consumption. Further, the reverse bias voltage and the amplitude of the sine wave can be set to desired values to intermittently apply the reverse bias voltage to the driver.

For example, the waveform of the reverse bias voltage applied to the driver can also be a square wave centered at a predetermined voltage serving as a reverse bias voltage. Also in this case, similar effects to those in the case of the attenuating sine wave described above can be achieved. Besides the attenuating sine wave and the square wave, any other waveform in which a voltage changes at predetermined intervals, such as a sine wave or a triangular wave, may be used.

Next, the absolute value of the upper limit of the reverse bias voltage applied to the driver will be described. The absolute value of the upper limit of the reverse bias voltage can be set to a value at which an electric field intensity generated between electrodes (gate and source) of the driver is not more than 1 MV/cm. Under an electric field intensity of 1 MV/cm, for example, in the case of a typical aSi-TFT including a gate insulation film with a thickness of about 4000 Å, a reverse bias voltage of about −40 V is applied to the insulation film. In the typical aSi-TFT, the quality of the insulation film may be deteriorated if a voltage of −40 V or more is applied. Therefore, the electric field intensity generated between the electrodes of the driver to which the reverse bias voltage is applied is set to not more than 1 MV/cm, whereby an aSi-TFT generally used for an image display apparatus can be used under good conditions.

For example, the absolute value of the upper limit of the reverse bias voltage can be set to a value at which the electric field intensity generated between the electrodes of the driver is not more than 0.1 MV/cm. This value can also be widely used for other TFTs, besides the aSi-TFT described above, as a value in a practically allowable range.

Second Embodiment

Figure 4:
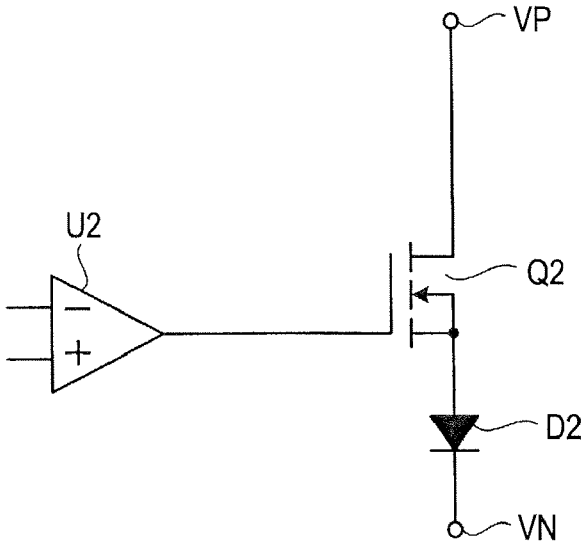
FIG. 4 is a diagram illustrating an example structure of a pixel circuit according to a second embodiment of the present invention.

FIG. 4 is a diagram illustrating an example structure of a pixel circuit different from the pixel circuit shown in FIG. 1. The pixel circuit shown in FIG. 4 has a structure equivalent to that of the pixel circuit shown in FIG. 1, except that a light emitting element D2 is connected to a source of a driver Q2. The pixel circuit shown in FIG. 4 is the same as that shown in FIG. 1 in that it has a "voltage control type" structure in which a gate of the driver Q2 is controlled. The pixel circuit shown in FIG. 4 is called "gate control/source drive".

The pixel circuit shown in FIG. 4 has a higher write voltage but smaller variations in deterioration across pixels than the pixel circuit shown in FIG. 1. The technique described above in which a reverse bias voltage is applied can also be used for the pixel circuit shown in FIG. 4, and similar advantages to those of the pixel circuit shown in FIG. 1 can be achieved. A controller U2 includes one or a plurality of TFTs, a capacitive element such as a capacitor, a control line for controlling the TFT, and so on.

Third Embodiment

Figure 5:
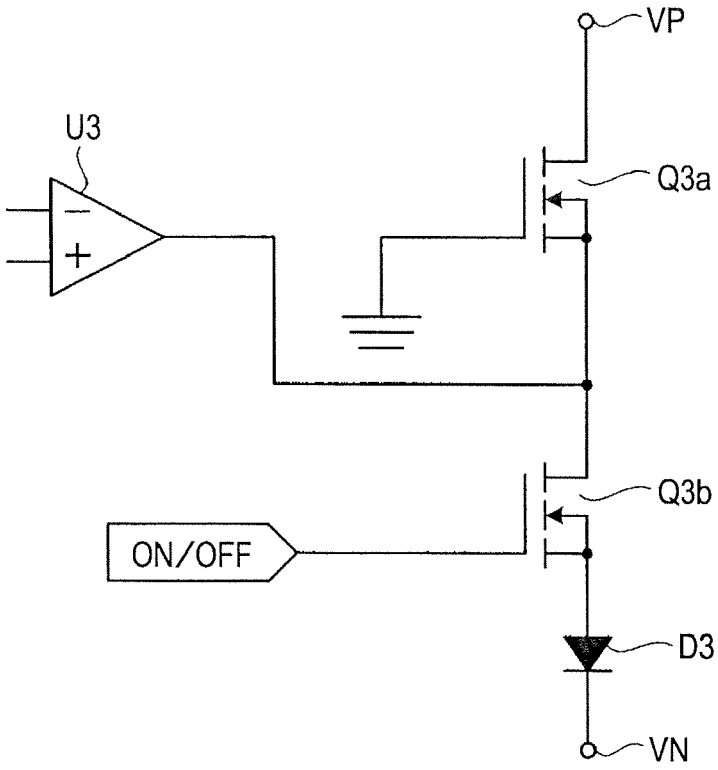
FIG. 5 is a diagram illustrating an example structure of a pixel circuit according to a third embodiment of the present invention.

FIG. 5 is a diagram illustrating an example structure of a pixel circuit different from the pixel circuits shown in FIGS. 1 and 4. The pixel circuit shown in FIG. 5 is similar to that shown in FIG. 4 in that a light emitting element D3 is connected to a source of a driver Q3*a*, but is different in that a gate terminal of a driver Q3*a* is grounded and a current at the source terminal of the driver Q3*a* is controlled by a controller U3. A switching element Q3*b* is a switching element for electrically separating the driver Q3*a* and the light emitting element D3 when a gate-source voltage of the driver Q3*a* is written. The pixel circuit shown in FIG. 5 has a "current control type" structure in which the source terminal of the driver Q3*a* is controlled. The pixel circuit shown in FIG. 5 is particularly called "source control/source drive". The controller U3 includes one or a plurality of TFTs, a capacitive element such as a capacitor, a control line for supplying a voltage controlling the TFT, a power supply line for supplying a power supply voltage, and so on.

The technique described above in which a reverse bias voltage is applied to a driver can also be used for the pixel circuit shown in FIG. 5, like the pixel circuits shown in FIGS. 1 and 4, and similar advantages to those of the pixel circuits shown in FIGS. 1 and 4 can be achieved.

Fourth Embodiment

Figure 6:
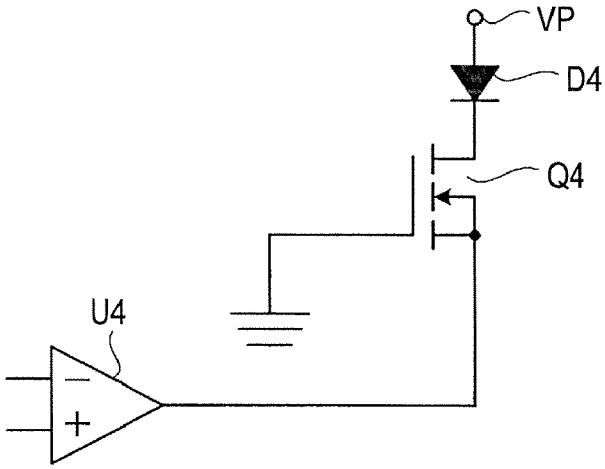
FIG. 6 is a diagram illustrating an example structure of a pixel circuit according to a fourth embodiment of the present invention.

FIG. 6 is a diagram illustrating an example structure of a pixel circuit different from the pixel circuits shown in FIGS. 1, 4, and 5. The pixel circuit shown in FIG. 6 is similar to that shown in FIG. 1 in that a light emitting element D4 is connected to a drain of a driver Q4, but is different in that a gate terminal of the driver Q4 is grounded and a current at a source terminal of the driver Q4 is controlled by a controller U4. The pixel circuit shown in FIG. 6 has a "current control type" structure in which the source terminal of the driver Q4 is controlled. The pixel circuit shown in FIG. 6 is particularly called "source control/drain drive". The controller U4 includes one or a plurality of TFTs, a capacitive element such as a capacitor, a control line for supplying a voltage controlling the TFT, a power supply line for supplying a power supply line, and so on.

The technique described above in which a reverse bias voltage is applied to a driver can also be used for the pixel circuit shown in FIG. 6, and similar advantages to those of the pixel circuits shown in FIGS. 1, 4, and 5 can be achieved.

Fifth Embodiment

Figure 17:
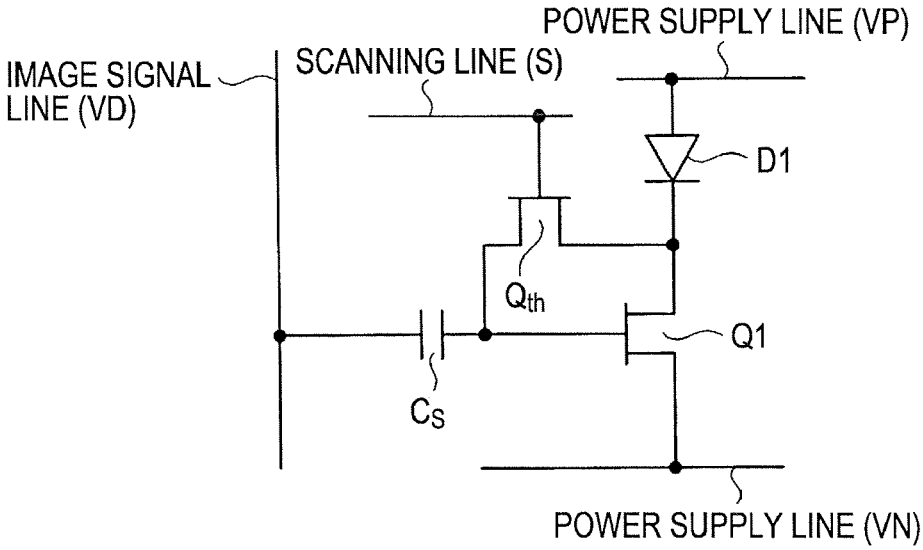
FIG. 17 is a circuit diagram of each of pixel circuits forming an image display apparatus according to a fifth embodiment of the present invention.

FIG. 17 is an equivalent circuit diagram of each of pixel circuits forming an image display apparatus according to the present embodiment. The pixel circuits are arranged in a matrix. Each of the pixel circuits includes an organic light emitting element D1, a driving transistor Q1 for controlling the organic light emitting element D1 to emit light, a capacitive element Cs having a first electrode and a second electrode where the first electrode is connected to a gate of the driving transistor Q1, and a switching transistor Qth for selectively short-circuiting the gate and drain of the driving transistor Q1. The pixel circuit further includes a power supply line VP connected to an anode of the organic light emitting element D1, a power supply line VN connected to the source of the driving transistor Q1, a scanning line S for controlling the driving of the switching transistor Qth, and an image signal line VD connected to the second electrode of the capacitive element Cs for supplying an image signal to the pixel circuit. Of those lines, the power supply line VP, the power supply line VN, and the scanning line S are commonly connected to pixel circuits arranged in the row direction, and the image signal line VD is commonly connected to pixel circuits arranged in the column direction.

Figure 18:
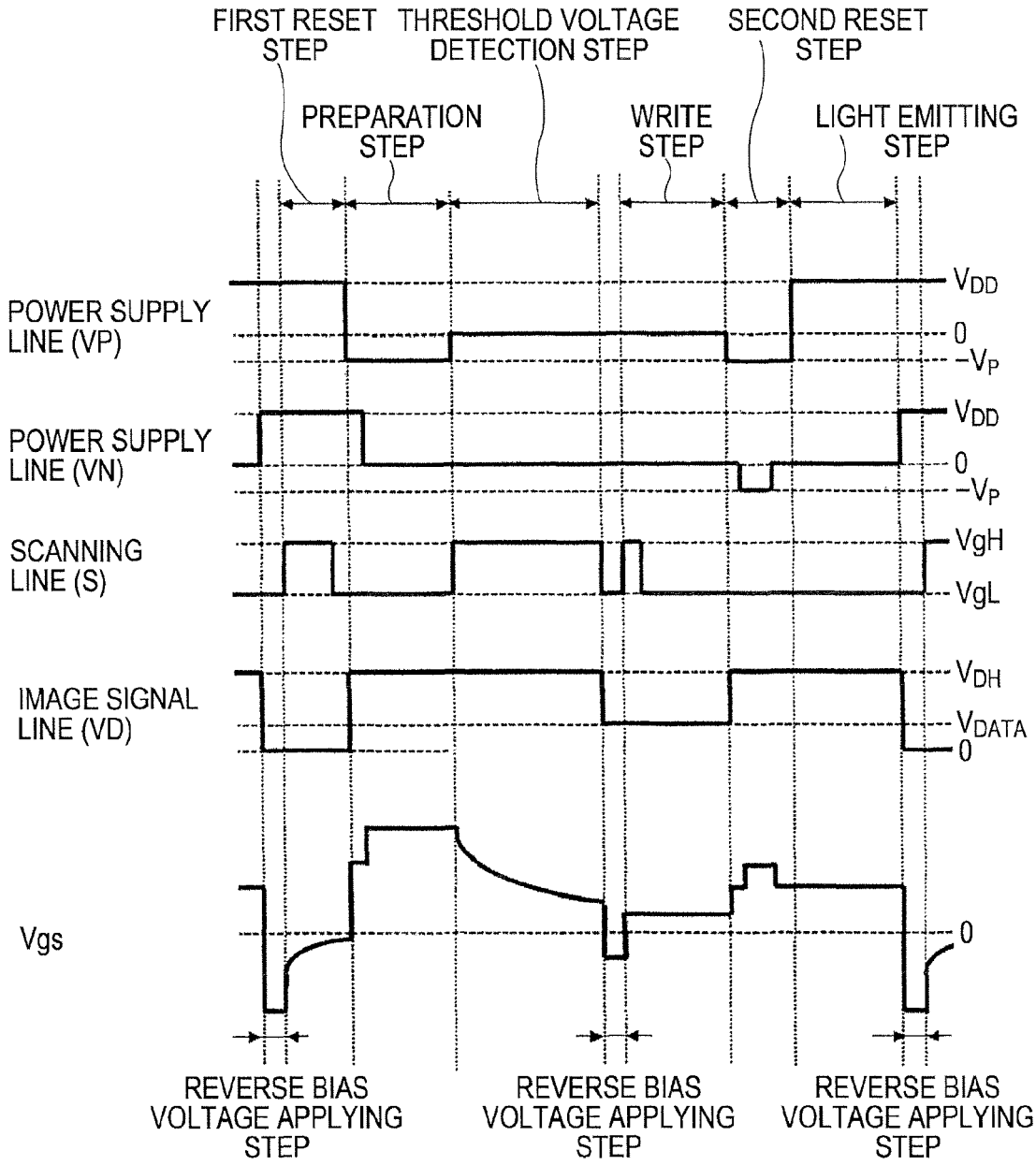
FIG. 18 is a time chart illustrating the operation of the image display apparatus illustrated in FIG. 17.

FIG. 18 is a time chart illustrating changes of the potentials of the power supply line VP, the power supply line VN, the scanning line S, and the image signal line VD, and changes in Vgs of the driving transistor of the image display apparatus according to the present embodiment during the operating time.

(First Reset Step)

First, a first reset step of resetting the potential applied to the gate of the driving transistor Q1 in the previous light emitting operation is performed. Specifically, as shown in FIG. 18, the potentials of the power supply lines VP and VN are held at $V_{DD}$, the image signal line VD at a 0 potential, and the scanning line S at a high-level potential (on potential: VgH). Thereby, the potentials at the source and drain of the driving transistor Q1 are substantially equal, and the driving transistor Q1 is substantially turned off. The switching transistor Qth is turned on, and the gate potential of the driving transistor Q1 becomes equal to $V_{DD}-V_{OLED}$. Therefore, the Vgs of the driving transistor Q1 becomes equal to $-V_{OLED}$. Since the electric charge accumulated in the organic light emitting element D1 gradually decreases, $V_{OLED}\approx 0$ (where $V_{OLED}<0$), that is, $Vgs\approx 0$ (where $Vgs<0$) is eventually obtained.

(Preparation Step)

Next, in a preparation step, the power supply line VP is held at −Vp (Vp<Vth), the image signal line at $V_{DH}$, and the scanning line S at an off potential (VgL). The potential of the power supply line VN is changed from $V_{DD}$ to 0V. As a result, the gate potential of the driving transistor Q1 becomes equal to $V_{DD}+V_{DH}$. Since the power supply line VN is changed from $V_{DD}$ to 0 V, the Vgs of the driving transistor Q1 is changed from $V_{DH}$ to $V_{DD}+V_{DH}$.

(Threshold Voltage Detection Step)

Then, the power supply lines VP and VN are held at 0 V, the scanning line S at the on potential (VgH), and the image signal line at $V_{DH}$. As a result, the switching transistor is turned on, and a current flows from the gate of the driving transistor Q1 to the source through the drain. This current flows until the Vgs of the driving transistor Q1 becomes substantially equal to the Vth, and the gate potential of the driving transistor Q1 finally becomes equal to the Vth. Therefore, the Vgs of the driving transistor Q1 becomes equal to the Vth.

(Reverse Bias Voltage Applying Step)

Next, a reverse bias voltage is applied to the driving transistor Q1. Specifically, the power supply lines VP and VN are held at 0 V, the scanning line S at the off potential (VgL), and the image signal line at 0 V. A large amount of electric charge is accumulated in the capacitive element Cs, and the gate potential of the driving transistor Q1 is changed to $V_{th}+V_{DATA}-V_{DH}$ in accordance with a change in the potential of the image signal line so that Vgs becomes equal to $V_{th}+V_{DATA}-V_{DH}$.

(Write Step)

Next, in the state where the power supply lines VP and VN are held at 0 V, the image signal line $V_D$ is set to $V_{DATA}$ ($0\leq V_{DATA}\leq V_{DH}$) at a timing when the scanning line S is set to the on potential (VgH), and $V_{DATA}$ is written. If it is assumed that the capacitance of the organic light emitting element D1 is represented by $C_{OLED}$, the gate potential of the driving transistor Q1 becomes equal to $\alpha(V_{DH}-V_{DATA})+Vth$, where $\alpha=C_{OLED}/(Cs+C_{OLED})$. Since the power supply line VN=0 V, the Vgs of the driving transistor Q1 becomes to $\alpha(V_{DH}-V_{DATA})+Vth$.

(Second Reset Step)

Next, a second reset step for resetting the electric charge accumulated in the organic light emitting element D1 is performed. Specifically, the power supply line VP is held at −Vp, the scanning line S at the off potential (VgL), and the image signal line at $V_{DH}$. The potential of the power supply line VN is changed from −Vp to 0. When the power supply line VN=−Vp, the potentials at the source and drain of the driving transistor Q1 are substantially equal, and the driving transistor Q1 is substantially turned off. Therefore, the gate potential of the driving transistor Q1 becomes equal to $\alpha(V_{DH}-V_{DATA})+Vth$, and Vgs is changed from $\alpha(V_{DH}-V_{DATA})+Vth+Vp$ to $\alpha(V_{DH}-V_{DATA})+Vth$.

(Light Emitting Step)

Then, the power supply line VP is held at $V_{DD}$, VN at 0 V, the scanning line S at the off potential (VgL), and the image signal line at $V_{DH}$. As a result, a current $Id=(\beta/2)[(1-\alpha)(V_{DH}-V_{DATA})]^2$ flows through the organic light emitting element D1, and the organic light emitting element D1 emits light.

(Reverse Bias Voltage Applying Step)

Then, a reverse bias voltage is applied to the driving transistor Q1. Specifically, the power supply lines VP and VN are held at $V_{DD}$, the scanning line S at the off potential (VgL), and the image signal line at 0 V. As a result, the gate potential of the driving transistor Q1 becomes equal to $V_{th}+\alpha(V_{DH}-V_{DATA})-V_{DH}$, and Vgs becomes equal to $V_{th}+\alpha(V_{DH}-V_{DATA})-V_{DD}-V_{DH}$.

Thereafter, by repeating the steps described above, the driving in which the reverse bias voltage is applied to the driving transistor Q1 for each frame is sequentially performed. In the case where a reverse bias voltage is applied for each frame, the reverse bias voltage (Vgs) is preferably −3 V to −10 V.

Sixth Embodiment

In this embodiment, a driving method of an electronic device having the image display apparatus described above will be described. A driving method that is different from a method of applying a reverse bias voltage to a driver in each frame period will be described herein. The term electronic device as used herein includes, as is to be anticipated, a mobile phone, a personal computer, a digital camera, a car navigation system, a PDA, a POS terminal, a measuring apparatus, and a copying machine.

Figure 14:
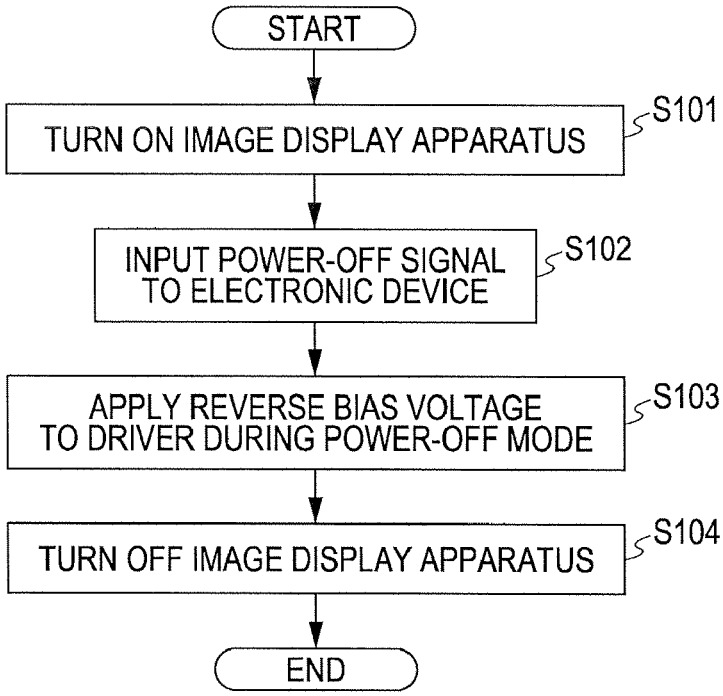
FIG. 14 is a flowchart illustrating a driving method of an electronic device according to a sixth embodiment of the present invention.

A. In the case where reverse bias voltages are applied to drivers when the image display apparatus is turned off from the on state (see FIG. 14):

(1) First, the image display apparatus is in an operating state, and an image is being displayed (step S101).

(2) Then, a power-off signal is input to the image display apparatus, and the image display apparatus is set to a power-off mode (step S102). The power-off mode is a state in which the image display apparatus has not yet been turned off although a power-off signal has been input.

(3) Here, in the state where the image display apparatus is in the power-off mode, reverse bias voltage applying signals are input to drivers of the image display apparatus, and reverse bias voltages are applied to the drivers by controllers (step S103).

(4) Then, after the reverse bias voltages have been applied to the drivers, the image display apparatus is turned off and enters a non-operating state (step S104).

Accordingly, by applying reverse bias voltages to drivers in a period for turning off the image display apparatus, the user of the electronic device can use the electronic device without feeling discomfort even in the case where the reverse bias voltages are applied.

Figure 15:
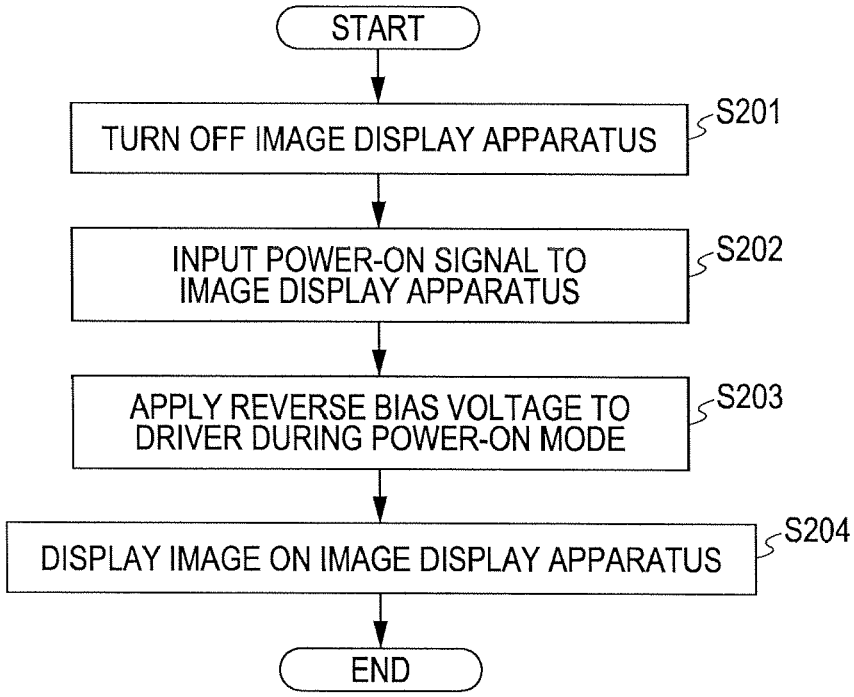
FIG. 15 is a flowchart illustrating the driving method of an electronic device according to the sixth embodiment of the present invention.

B. In the case where reverse bias voltages are applied to drivers for a period from a state in which the image display apparatus is turned off until an image is displayed (see FIG. 15):

(1) First, the image display apparatus is in a non-operating state, and the image display apparatus is in an off state (step S201). In the off state, no voltage is supplied to power supply lines electrically connected to light emitting elements.

(2) Then, a power-on signal is input to the image display apparatus, and the image display apparatus is set to a power-on mode (step S202). The power-on mode is a state in which no image is being actually displayed on the image display apparatus although a power-on signal has been input.

(3) Here, in the state where the image display apparatus is in the power-on mode, reverse bias voltage applying signals are input to drivers of the image display apparatus, and reverse bias voltages are applied to the drivers by controllers (step S203).

(4) Then, after the reverse bias voltages have been applied to the drivers, an image is displayed on the image display apparatus (step S204).

Accordingly, by applying reverse bias voltages to drivers in a period for turning on the image display apparatus, the user of the electronic device can use the electronic device without feeling discomfort even in the case where the reverse bias voltages are applied.

Figure 16:
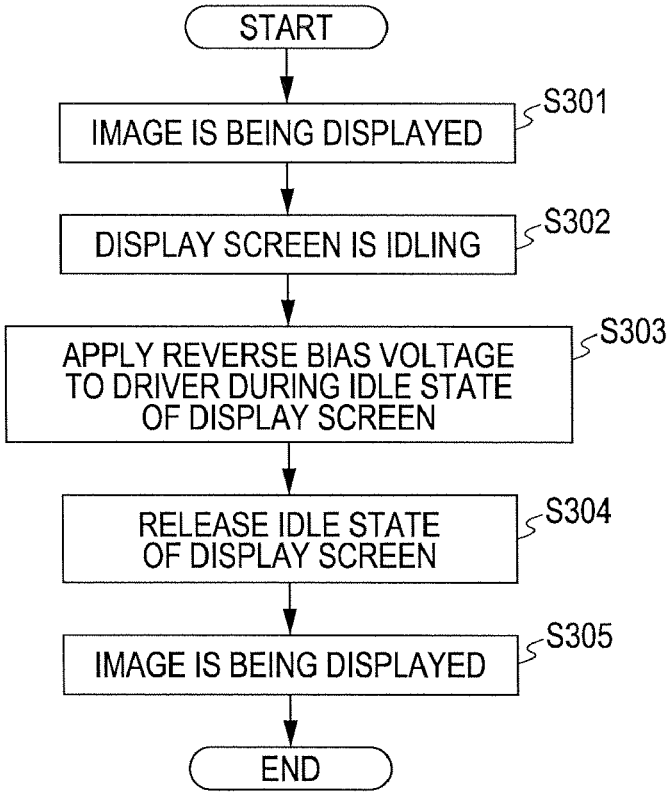
FIG. 16 is a flowchart illustrating the driving method of an electronic device according to the sixth embodiment of the present invention.

C. In the case where reverse bias voltages are applied to drivers in a period during which the image display apparatus is turned on but a display screen of the image display apparatus is in an idle state (see FIG. 16):

(1) First, the image display apparatus is in an operating state, and a first image is being displayed by the image display apparatus (step S301).

(2) Then, the display screen of the image display apparatus enters an idle state (step S302). The idle state is a state in which, for example, no image is being displayed on the display screen, a state in which a screen saver is running, a state in which an image is being displayed on the display screen with a lower brightness than that of the first image, a state in which an image is being displayed on the display screen but cannot be visually observed from the outside (a state in which the image is hidden) (for example, a casing of a foldable mobile phone is folded so that the screen is hidden by the casing) or the like.

(3) Here, reverse bias voltage applying signals are input to drivers of the image display apparatus, and reverse bias voltages are applied to the drivers by controllers (step S303).

(4) Then, after the reverse bias voltages have been applied to the drivers, the idle state of the display screen is released (step S304), and an image is displayed on the image display apparatus (step S305). The display screen may still be in the idle state even after the reverse bias voltages have been applied.

Accordingly, by applying reverse bias voltages to drivers in a period during which the display screen of the image display apparatus is in the idle state, the user of the electronic device can use the electronic device without feeling discomfort even in the case where the reverse bias voltages are applied.

The present invention is not limited to the embodiments described above, and a variety of improvements and modifications can be made without departing from the scope of the present invention.

What is claimed is:

1. An image display apparatus comprising:

a plurality of pixel circuits, each comprising:

a light emitting element electrically connected to a first power supply line; and a driver electrically connected to the light emitting element and a second power supply line, a reverse bias voltage being applied to the driver, wherein a potential difference between the first power supply line and the second power supply line is substantially maintained during a reverse bias voltage period in which the reverse bias voltage is applied to the driver, wherein a write period in which an image signal is written is not overlapped with the reverse bias voltage period, wherein an electric charge accumulated in the light emitting element is reset by substantially equating a drain potential of the driver with a source potential of the driver before a light emitting period in which the light emitting element emits, and wherein a voltage between a gate and a source of the driver is not equal to zero when resetting the electric charge accumulated in the light emitting element in a reset period immediately before the light emitting period.

2. The image display apparatus according to claim 1, wherein the reverse bias voltage is applied to the driver when the image display apparatus is a first state in which a power-off signal is input into the image display apparatus, and wherein the image display apparatus is to be a second state in which the image display apparatus is turned off after the reverse bias voltage is applied to the driver.

3. The image display apparatus according to claim 1, wherein the reverse bias voltage is applied to the driver when the image display apparatus is a first state in which a power-on signal is input into the image display apparatus or in which the image display apparatus is idling, and wherein the image display apparatus is to be a second state in which the image display apparatus displays an image after the reverse bias voltage is applied to the driver.

4. The image display apparatus according to claim 1, wherein the reverse bias voltage is applied to the driver when the light emitting element does not emit light or when the image display apparatus is not used.

5. The image display apparatus according to claim 1, wherein a waveform of the reverse bias voltage applied to the driver has a predetermined cycle.

6. The image display apparatus according to claim 1, wherein a waveform of the reverse bias voltage is attenuating wave.

7. The image display apparatus according to claim 1, wherein an absolute value of the reverse bias voltage applied to the driver is not less than 1 V.

8. The image display apparatus according to claim 1, wherein an electric field intensity between electrodes of the driver to which the reverse bias voltage is applied is not more than 1 MV/cm.

9. The image display apparatus according to claim 1, wherein the reverse bias voltage applied to each driver is substantially equal in regard to all of the drivers.

10. An image display apparatus comprising:

a light emitting element electrically connected to a first power supply line;

a driver electrically connected to the light emitting element and a second power supply line; and a controller electrically connected to the driver and configured to apply a reverse bias voltage to the driver, wherein a potential difference between the first power supply line and the second power supply line is substantially maintained during a reverse bias voltage period in which the reverse bias voltage is applied to the driver, wherein a write period in which an image signal is written is not overlapped with the reverse bias voltage period, wherein an electric charge accumulated in the light emitting element is reset by substantially equating a drain potential of the driver with a source potential of the driver before a light emitting period in which the light emitting element emits, and wherein a voltage between a gate and a source of the driver is not equal to zero when resetting the electric charge accumulated in the light emitting element in a reset period immediately before the light emitting period.

11. A driving method of an image display apparatus including a plurality of light emitting elements and a plurality of drivers, the driving method comprising:

applying a voltage to the drivers such that the plurality of light emitting elements emit light; and applying the reverse bias voltages to the drivers, wherein the plurality of light emitting elements are electrically connected to a first power supply line, wherein the drivers are electrically connected to the plurality of light emitting elements and a second power supply line, wherein a potential difference between the first power supply line and the second power supply line is substantially maintained during a reverse bias voltage period in which the reverse bias voltages are applied to the drivers, wherein a write period in which an image signal is written is not overlapped with the reverse bias voltage period, wherein an electric charge accumulated in the plurality of light emitting elements is reset by substantially equating a drain potential of the drivers with a source potential of the drivers before a light emitting period in which the plurality of light emitting elements emit, and wherein a voltage between a gate and a source of the drivers is not equal to zero when resetting the electric charge accumulated in the plurality of light emitting elements in a reset period immediately before the light emitting period.

12. The driving method according to claim 11, wherein the reverse bias voltage period in which the reverse bias voltage are applied to the drivers is not less than 5% of one frame period.

13. The driving method according to claim 11, wherein the reverse bias voltage period in which the reverse bias voltages are applied to the drivers is not less than 50% of an average light-emitting period which is an average of time for which a light emitting element emits light in one frame period.

14. The driving method according to claim 11, wherein the reverse bias voltage period in which the reverse bias voltages are applied to the drivers is not more than 20% of total time of using the image display apparatus.

15. A driving method of an electronic device comprising an image display apparatus having a plurality of light emitting elements and a plurality of drivers, the driving method comprising:

setting the image display apparatus to a first state;

applying reverse bias voltages to the drivers; and setting the image display apparatus to a second state, wherein the plurality of light emitting elements are electrically connected to a first power supply line, wherein the drivers are electrically connected to the plurality of light emitting elements and a second power supply line, wherein a potential difference between the first power supply line and the second power supply line is substantially maintained during a reverse bias voltage period in which the reverse bias voltage is applied to the drivers, wherein a write period in which an image signal is written is not overlapped with the reverse bias voltage period, wherein an electric charge accumulated in the plurality of light emitting elements is reset by substantially equating a drain potential of the drivers with a source potential of the drivers before a light emitting period in which the plurality of light emitting elements emit, and wherein a voltage between a gate and a source of the drivers is not equal to zero when resetting the electric charge accumulated in the plurality of light emitting elements in a reset period immediately before the light emitting period.

16. The driving method according to claim 15, wherein the first state is a state in which a power-off signal is input into the image display apparatus, and wherein the second state is a state in which the image display apparatus is turned off.

17. The driving method according to claim 15, wherein the first state in which a power-on signal is input into the image display apparatus or in which the image display apparatus is idling, and wherein the second state is a state in which the image display apparatus displays an image.

* * * * *